United States Patent [19]

Miller

[11] 4,038,712

[45] Aug. 2, 1977

[54] MATTRESS CONSTRUCTION

[76] Inventor: Craig Salvatore Miller, 1221 S. Marine, Santa Ana, Calif. 92704

[21] Appl. No.: 569,665

[22] Filed: Apr. 21, 1975

[51] Int. Cl.[2] ..... A47C 27/08

[52] U.S. Cl. ..... 5/371

[58] Field of Search ..... 5/348 A, 348 WB, 348 R; 18/19

[56] References Cited

U.S. PATENT DOCUMENTS

| | | | |
|---|---|---|---|
| 3,778,852 | 12/1973 | Penn et al. | 5/371 |
| 3,842,455 | 10/1974 | Whitney | 5/371 |
| 3,918,110 | 11/1975 | Cantillo | 5/371 |

*Primary Examiner*—Paul R. Gilliam
*Assistant Examiner*—Andrew M. Calvert
*Attorney, Agent, or Firm*—Richard L. Myers

[57] ABSTRACT

A mattress includes a first bag forming a first cavity and being disposed within a second bag of substantially the same size. Each of the bags includes a pair of generally flat portions connected at a peripheral edge. Two separate continuous lap seams join the bags inwardly of their edge portions on opposite sides of the bags. These seams define with the edge portions of the bags a second cavity which is disposed around the first cavity. The first cavity can be filled with water to form a water mattress and the second cavity can be filled with air to form a peripheral air frame.

In a preferred method, the mattress can be formed from four vinyl sheets of the same size using only four horizontal lap seams. The first bag can be provided with an inner peripheral lap seam by removing a ground rod associated with a heat sealer through a water valve. The second bag can be provided with an external peripheral seam by removing the ground rod through an air valve.

22 Claims, 18 Drawing Figures

4
59
65
11
63
37
4
25
35
21
17
35
25
13
15
23
19
47

25
4
59
35
67
17
67
65
37
63
3
3
25
4

37
67
17
37
25
25
47
19
67
47

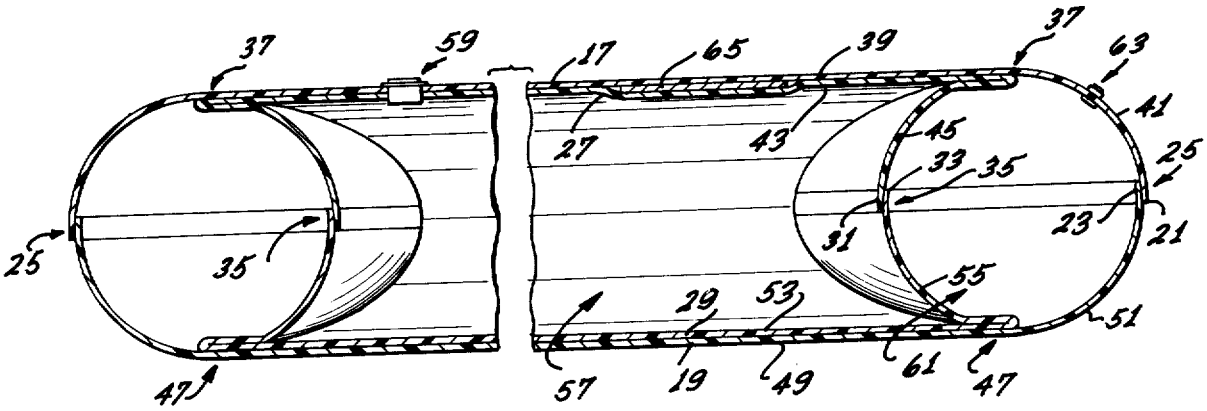
FIG. 4
FIG. 6
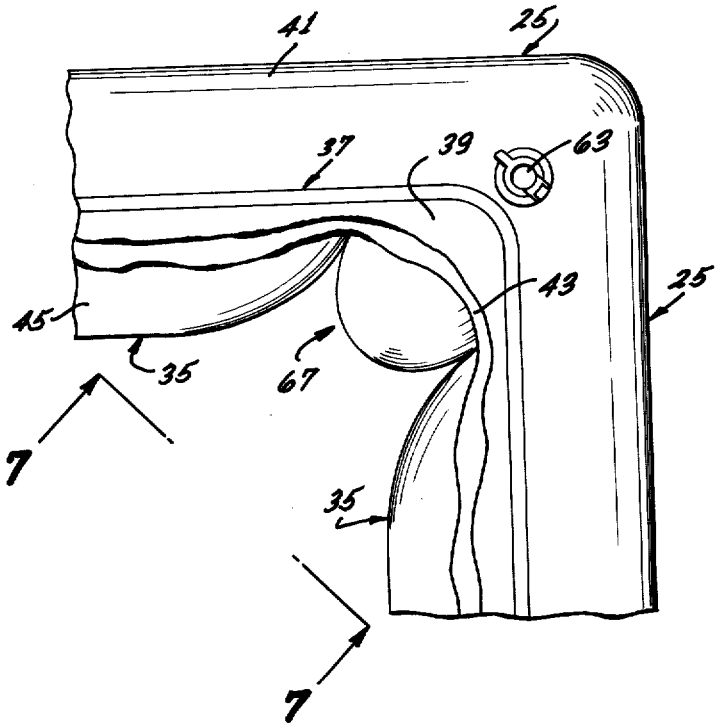
FIG. 7
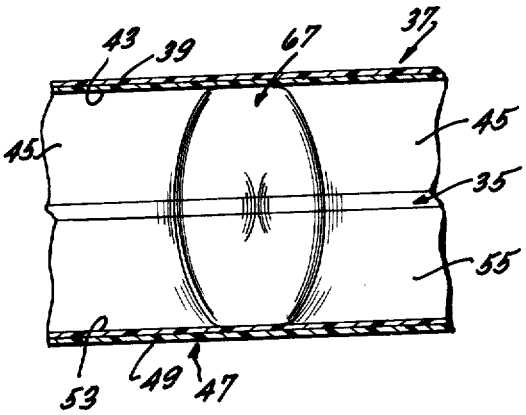
FIG. 5
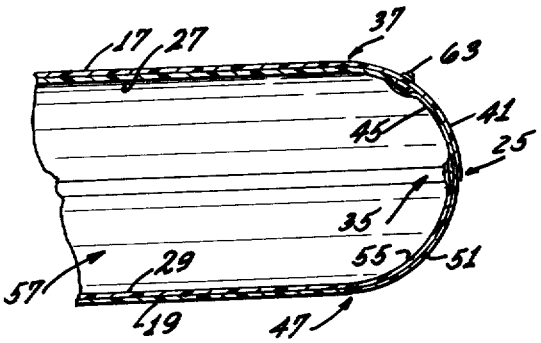

FIG. 10
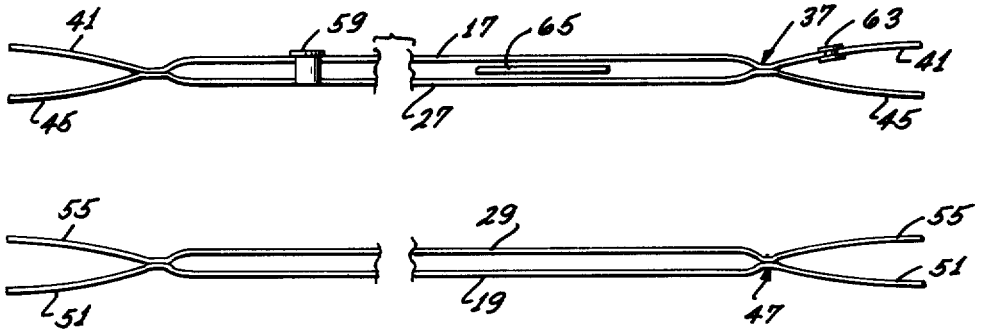
FIG. 11
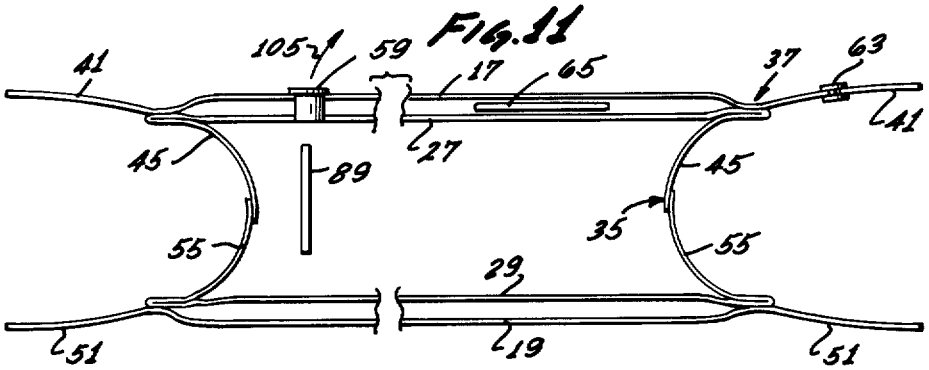
FIG. 12
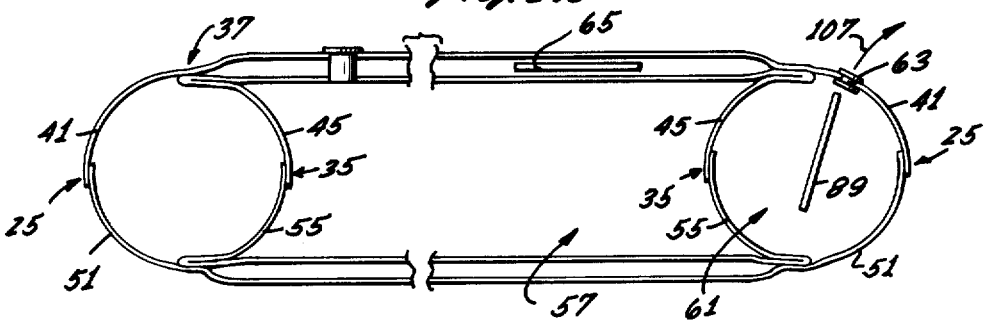
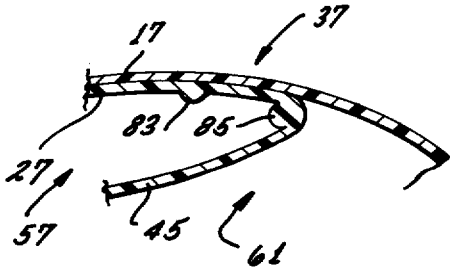
FIG. 13

Fig. 8a
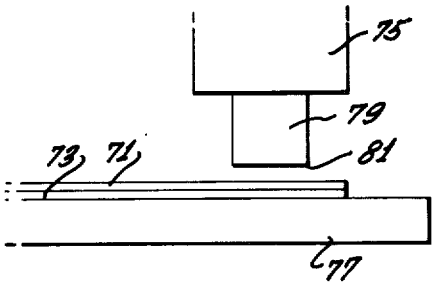
Fig. 8b
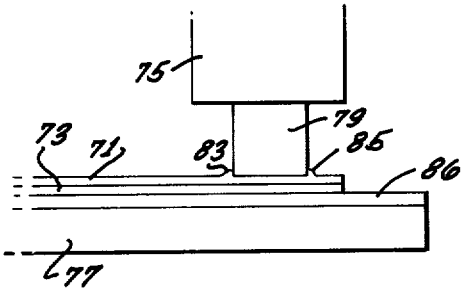
Fig. 8c
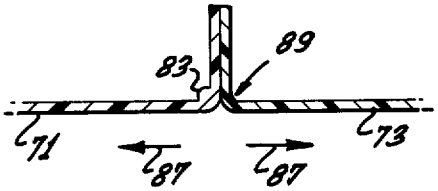
Fig. 8d
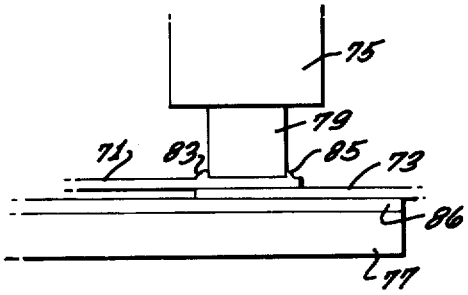
Fig. 8e
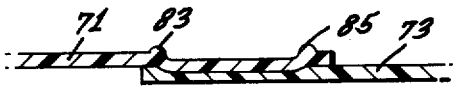
Fig. 8f
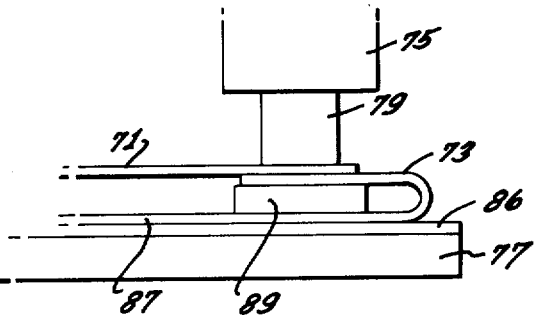
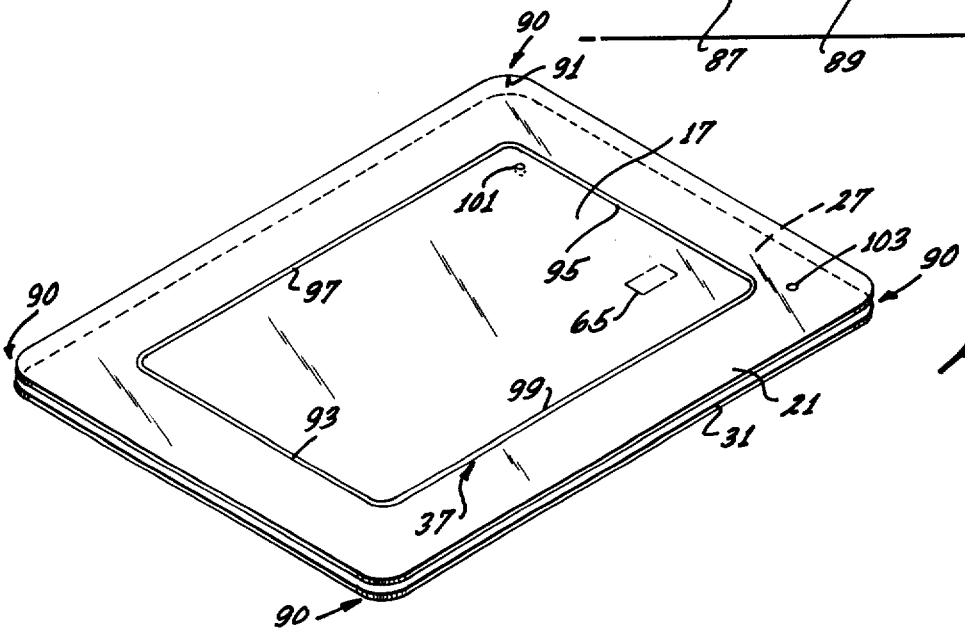
Fig. 9

MATTRESS CONSTRUCTION

BACKGROUND OF THE INVENTION

1. Field of the Invention

The present invention is concerned generally with mattress constructions and more specifically with mattresses forming water beds.

2. Description of the Prior Art

In its simpliest form, a water bed includes a bag or bladder having the generally flat configuration of a mattress and defining a fluid tight cavity. A valve extending into the bag permits filling of the cavity with a fluid such as water. The bags are typically constructed of a flexible material such as vinyl which can be heat sealed to itself to provide the bag with a desired configuration. Mattresses of this type, such as that disclosed by Hall in U.S. Pat. No. 3,585,356, are well known to provide an excellent surface upon which a person can lie. The water in the bag provides for an even distribution of the supporting force so that the pressure on the body of the person is substantially constant over all areas of contact. In the absence of high pressure areas of contact, the water bed has excellant therapeutic characteristics which enable a person to lie in one position for an extended period of time.

A problem common to all water mattresses is associated with the significant fluid pressures which are developed within the bag due to the large quantity of water in the cavity. These pressures have a particularly adverse affect on the seams which are formed when the various pieces of the material are bonded together.

It is known that lap seams are generally more desirable than butt seams in opposing these significant pressures. A lap seam is placed in shear stress by such pressures while a butt seam is placed in tensile stress by such pressures. Since the shear stress of a seam typically exceeds the tensile stress of a seam, the lap seam construction is generally preferred for water beds. A water mattress illustrating lap seam construction is disclosed by Kuss in U.S. Pat. No. 3,753,823.

In order to form a lap seam, a radio frequency heat sealer is used in conjunction with a die rod which is pressed into contact with overlapping portions of the material to be joined. Then radio frequency waves are transmitted by the heat sealer through the die rod to melt the overlapping portions of the material and effect a seal therebetween.

A lap seam construction for a bag is more difficult. In such a construction, a heat sink rod or buffer must be provided interiorly of the bag with the die rod pressed against the overlapping portions and against the heat sink rod. The heat sink rod ensures that only the material between the heat sink rod and the die rod is melted by the radio frequency waves. Other portions of the bag on which the heat sink rod might rest are not melted.

Of course, once the heat sink rod or buffer is disposed within the cavity, it must remain in the cavity or otherwise be removed from the cavity. In the Kuss U.S. Pat. No. 3,753,823, access holes are provided through which heat sink rods can be disposed to provide for the lap seam construction. When the final seam is made to seal the access holes, a buffer sheet is used which remains within the sealed bag.

Water mattresses consisting of only a single bag or bladder are typically supported within a rigid frame having side members which provide lateral support for the water filled bag. In other types of construction, a second cavity has been provided to form a loop around the sides of the water filled cavity. This second cavity has been filled with air to provide an air frame for the water mattress. With this configuration, no rigid side support members need be provided for the water mattress. U.S. Pat. No. 3,787,907, issued to Pennington, is representative of this air frame construction. A patent issued to Penn, U.S. Pat. No. 3,778,852, also shows an air frame construction. Other patents including pneumatic side walls include those issued to Whitney, U.S. Pat. No. 3,842,455, and Shields, U.S. Pat. No. 3,766,579.

Although the provision of a pneumatic chamber surrounding a water mattress has significant advantages, this construction in the past has called for the provision of many separate pieces of material and the formation of many bonds in order to provide the desired configuration. Of course, the greater number of bonds the greater is the possibility that a seal will be formed which is too weak to withstand the significant pressures associated with the water in the mattress. In order to speed the construction of this type of mattress, many of these seals have been formed with the less desirable butt seam construction. For example, vertical butt seams provided in the corners of some of the mattresses have been particularly susceptible to rupture.

SUMMARY OF THE INVENTION

The mattress construction of the present invention is of the type having a pneumatic chamber surrounding a water bed. This mattress can be formed from only four sheets of material having the same initial size. All of the seals, which are of the preferable lap seam construction, are in planes substantially parallel to the horizontal configuration of the mattress. In the corners of the air frame, a bubble configuration provides excess material which relieves the pressure strain in these areas. Furthermore, this mattress construction can be used either as a water bed having a double thickness of material, or as a water bed surrounded by an air frame.

In its simpliest form, the mattress can be formed by two bags having substantially equal surface areas and similar flat shapes. With one of the bags disposed in the other of the bags, the two contiguous flat portions on one side of the mattress can be joined along a seam displaced inwardly from the peripheral edges of the bags. A second similar continuous seam can join the contiguous flat surfaces on the opposite side of the mattress. With this construction, the inner bag provides a water cavity which is isolated from the environment by two thicknesses of the bag material. A second cavity which is formed between the peripheral edges of the inner and outer bag, is bounded by the first and second seals. This second cavity provides a pneumatic chamber which surrounds the water in the inner bag to provide an air frame for the mattress.

In a preferred method of construction, four rectangularly shaped sheets of material all having the same size can be provided. A first and second sheet of the material can be heat sealed to each other along a continuous line displaced inwardly from the peripheral edges of the first and second sheets. This provides the first seal in the mattress construction. Third and fourth sheets of the material can be similarly heat sealed to provide the second seal in the mattress construction. Then the peripheral edges of the second and third sheets can be joined in a lap seam configuration. Finally, the peripheral edges of the first and fourth sheets can be joined in a lap seam configuration. A valve extending through both the first and second sheets provides access into the inner bag through which a heat sink rod can be removed upon completion of the final lap seam joining the second and third sheets. A similar valve extending into the surrounding pneumatic chamber provides a hole through which a heat sink rod can be removed upon completion of the lap seam joining the first and fourth sheets.

Thus with the provision of only four seams of the preferred lap seam type, the advantageous air frame construction can be provided. Additionally, there are no vertical seams in this mattress construction. Furthermore, the mattress can be used either solely as a water mattress or as a water mattress having a surrounding air frame.

These and other features and advantages of the invention will become more apparent with the description of the preferred embodiments and reference to the associated drawings.

DESCRIPTION OF THE DRAWINGS

FIG. 4 is a cross sectional view taken along lines 4—4 of FIG. 2 and illustrating an inflated air frame;

FIG. 5 is a partial cross sectional view similar to FIG. 4 illustrating use of the mattress with a deflated air frame;

FIG. 6 is a fragmentary plan view of a corner of the mattress illustrated in FIG. 1;

FIG. 7 is an elevational view along lines 7—7 of FIG. 6;

FIG. 8*a* is an elevational view illustrating a heat sealer prior to formation of a heat seal;

FIG. 8*b* is an elevational view of the heat sealer being used to form a butt seam;

FIG. 8*c* is a cross sectional view of the butt seam formed in accordance with the step illustrated in FIG. 8*b;*

FIG. 8*d* is an elevational view illustrating the formation of a lap seam using a heat sealer in accordance with a preferred method of the present invention;

FIG. 8*e* is a cross sectional view of a lap seam formed in accordance with the step illustrated in FIG. 8*d;*

FIG. 8*f* is an elevational view illustrating a method of forming a lap seam to seal a bag;

FIG. 9 is a perspective view illustrating a preferred method for joining a pair of sheets to form a portion of one embodiment of the mattress of the present invention;

FIG. 10 is an elevational view illustrating a preferred disposition of sheet members used to form the mattress of FIG. 9;

FIG. 11 is an elevational view illustrating formation of an internal peripheral seam in a preferred method of the present invention;

FIG. 12 is an elevational view illustrating formation of an external peripheral seam in a preferred method of the present invention; and FIG. 13 is an enlarged cross sectional view of an integral lap seam illustrated in FIG. 4.

DESCRIPTION OF THE PREFERRED EMBODIMENTS

Figure 1:
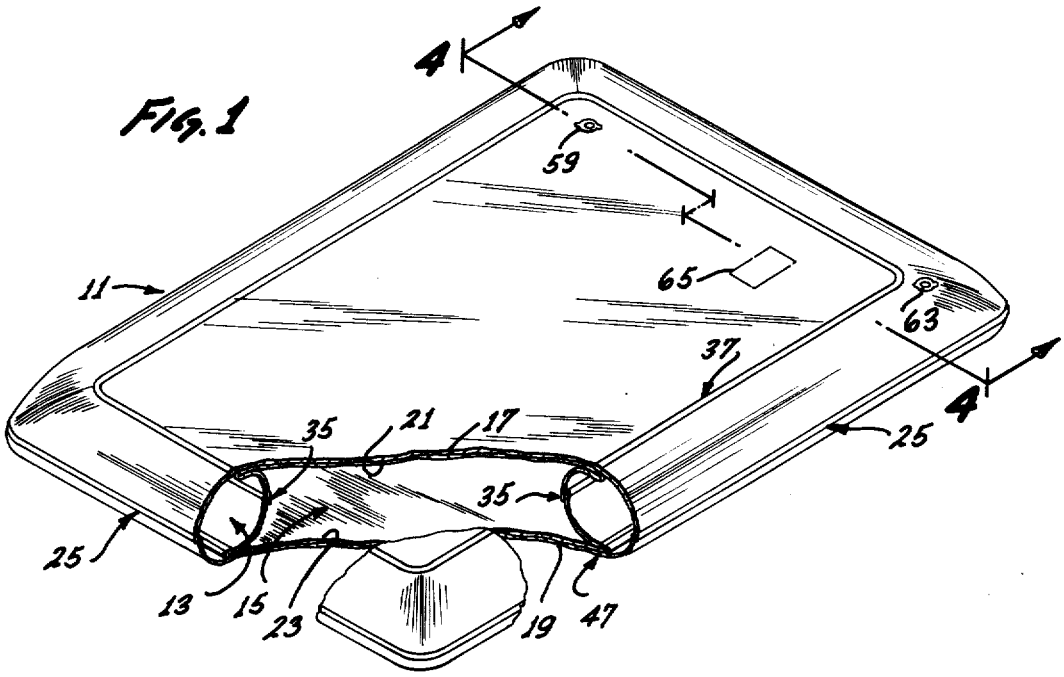
FIG. 1 is a fragmentary perspective view of one form of the mattress of the present invention.
Figure 2:
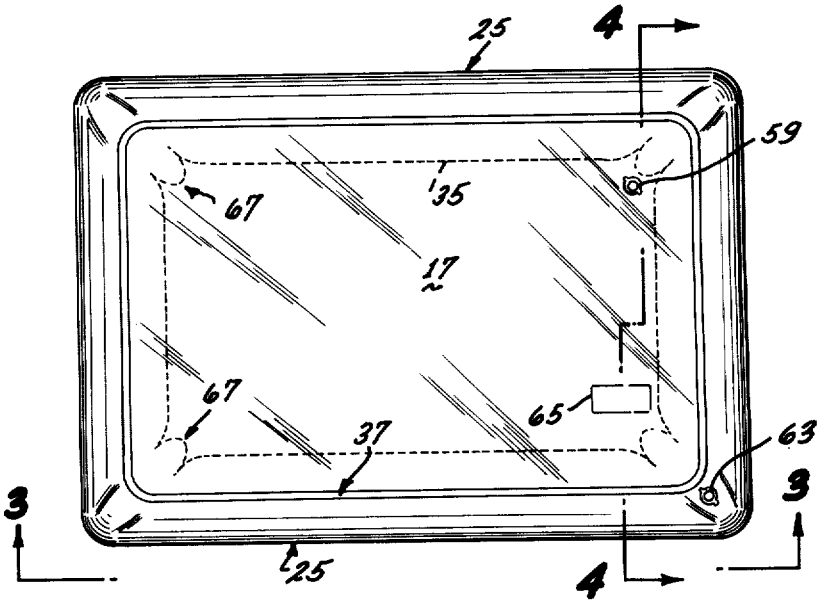
FIG. 2 is a plan view of the mattress illustrated in FIG. 1.
Figure 3:
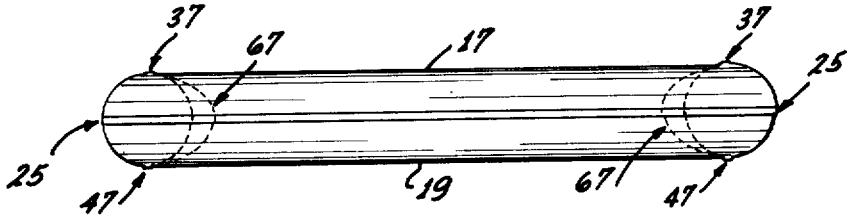
FIG. 3 is a side view taken along lines 3—3 of the mattress illustrated in FIG. 2.

One form of the mattress of the present invention is illustrated in FIG. 1 and designated generally by the reference numeral 11. This mattress 11 includes an outer bag 13 and an inner bag 15 which is disposed within the outer bag 13. The bags 13 and 15 are similar in that they have substantially the same surface area and configuration.

In a preferred embodiment of one form of the invention, the bags 13 and 15 are formed from a pair of sheet members which are joined at their peripheral edges. For example, with particular reference to FIG. 4, it will be noted that the outer bag 13 can be formed from a pair of flexible sheet members 17 and 19 having respective peripheral edges 21 and 23 which are overlapped and joined to form a lap seam 25. Similarly, the inner bag 15 can be formed from a pair of flexible sheet members 27 and 29 having respective peripheral edges 31 and 33 which are overlapped and joined to form a lap seam shown generally at 35.

In a preferred embodiment, the sheet members 17 and 27 are bonded together to form an integral lap seam 37. This lap seam 37 extends along a continuous path on the upper side of the mattress 11 and is preferably displaced a constant and equal distance from the peripheral edges 31 and 21 of the sheet members 27 and 17 respectively. The integral lap seam 37 separates the sheet members 17 into a central portion 39 and a lateral portion 41. Likewise, the seam 37 separates the sheet member 27 into a central portion 43 and a lateral portion 45.

On the opposite side of the mattress 11, the sheet members 29 and 19 can be similarly bonded to form an integral lap seam shown generally at 47. The lap seam 47 extends along a continuous path on the bottom side of the mattress 11 and is disposed a constant and equal distance between the peripheral edges 23 and 33 of the sheet members 19 and 29 respectively. In the preferred embodiment, the distance separating the peripheral edges 23, 33 and the seam 47 is equal to the distance separating the peripheral edges 31, 21 and the seam 37. Furthermore, this distance is greater than one-half of the desired thickness of the mattress 11.

The integral lap seam 47 separates the sheet member 19 into a central portion 49 and a lateral portion 51. This seam 47 also separates the sheet member 29 into a central portion 53 and a lateral portion 55.

Each of the seams 25, 35, 37 and 47 is a continuous seam and lies in a plane which is substantially parallel to the flat configuration of the mattress 11. In a preferred embodiment, the seams 25 and 35 lie in substantially the same plane. Also, the seams 37 and 47 may be disposed with respect to each other in a direction substantially perpendicular to their respective planes.

It can now be seen that the inner bag 15 formed by the sheet members 27 and 29 and the lap seam 35 provides a first major cavity 57 which extends across a major portion of the central area of the mattress 11. Access into this cavity 57 can be provided by a valve 59 of a conventional type which extends through the sheet members 17 and 27. In a typical use of the mattress 11, the cavity 57 is filled with water through the valve 59.

Of particular interest to the present invention is a second major cavity 61 which is formed between the lateral portions 41, 45, 51 and 55 of the sheet members 17, 27, 19 and 29 respectively. Since these lateral portions are all joined by the seams 21, 31, 37 and 47, they form a continuous loop around the periphery of the first cavity 57. Access to this second major cavity 61 can be provided by a conventional valve 63 which through the lateral portion 41 of the sheet member 17. This cavity 61 can be filled with air through the valve 63 to provide an air frame for the mattress 11.

The second major cavity 61 is preferably filled with air to a pressure greater than that of the water in the first major cavity 57. This will provide the second major cavity 61 with a somewhat circular cross section. With this configuration, the lateral portions 45 and 55 have a generally concave relationship with the first cavity 57 and the lateral portions 41 and 51 have a generally convex relationship with the first cavity 57.

In the past labels showing the name of the manufacturer and other data pertinent to the construction and use of mattress have been attached to the outer surface of the mattress using adhesives. These adhesives have been ineffective in attaching the labels to the relatively smooth materials of which the mattresses have been formed. Furthermore, the labels have been susceptible to contamination and wear due to their exposure to the environment.

The construction of the present mattress 11 provides a pocket between the central portions 39 and 43 of the respective sheet members 17 and 27, a pocket which is permanently sealed by the integral lap seam 37. During the construction of the mattress 11, a label 65 can be placed in this pocket. In this location, the label 65 need not be adhered to the mattress 11. It is isolated from the water in the cavity 57 by the sheet member 27 and is isolated from the environment by the sheet member 17. If the mattress 11 is formed from translucent materials, the indicia on the label 65 can be read through the sheet member 17.

Although the second major cavity 61 can be filled with air to provide lateral support for the water mattress, it may be desirable where other lateral support is provided, to evacuate the cavity 61 so that the lateral portions 45 and 55 extend into contact with the lateral portions 41 and 51 as illustrated in FIG. 5. When the mattress 11 is used in this manner, the first major cavity 57 extends to the peripheral edges of the mattress 11; and both the lateral portions. 45, 55 and the lateral portions 41, 51 have a generally convex relationship to the cavity 57.

It was particularly surprising to find when the lateral portions 45, 55 and the lateral portions 41, 51 have equal surface areas and the cavity 61 therebetween is inflated, an excess of material is provided on the inside corners of the air frame. This excess material tends to form a bubble designated generally by reference numeral 67 in FIG. 6. In the past, these corner areas of the air frame have often included vertical seams which have been particularly susceptible to rupture by the significant pressures in the mattress.

This is not the case with the present mattress 11 for several reasons. First, there are no vertical seams anywhere in the mattress 11. Each of the four seams 25, 35, 37 and 47 lies in a respective plane which is substantially parallel to the flat configuration of the mattress 11. Furthermore, the excess material forming the bubble 67 in the corners of the air frame provides an increased flexibility which tends to relieve the stress in these areas. The bubbles 67 form relief members which can move outwardly of the first cavity 57 when the pressure in the cavity 57 exceeds the pressure in the cavity 61, and can move inwardly of the cavity 57 when the pressure in the cavity 61 exceeds the pressure in the cavity 57. With this highly advantageous construction, the lap seam 35 which extends around the peripheral inner edge of the air frame traverses a path which in a plan view such as that illustrated in FIG. 6 has a general M-shape, in each of the corners. It will be appreciated that this excess material may have other configurations providing means for relieving pressure differentials between the cavities 57 and 61 in other embodiments of the invention.

It will now be apparent that the construction of the mattress 11 with outer and inner bags 13 and 15 respectively of substantially the same size provides the mattress 11 with at least two significant advantages. First, the mattress 11 can be used alternatively either with or without the peripheral air frame. Second, when the second cavity 61 is inflated, an excess of material appears on the inside corners of the air frame to relieve the pressures in these areas.

In a preferred form of the mattress 11, the sheet members 17, 19, 27 and 29 are formed from a flexible plastic material such as the heavy duty vinyl film distributed under the trademark APONYL by Goss Plastic Film Corporation of Los Angeles, Calif. This material is a twenty gauge pinhole-free vinyl film which is waterextraction resistance, has excellent tear and tensile strengths, and superior heat sealing properties which make it particularly desirable for water mattress constructions. It will be apparent that the mattress 11 can be formed from other types of fluid proof materials, but the plastic materials are preferred because they can be heated sealed using a radio frequency dielectric sealer to form the seams 25, 35, 37 and 47.

Another feature of particular advantage to the present invention is associated with the seams 25, 35, 37 and 47 each of which has the desirable lap seam construction. The advantage of this type of seam can be more easily understood with reference to FIGS. **8*a*–8*f*. The typical formation of a seam is illustrated in FIG. 8*a* where two pieces of flexible plastic material 71 and 73 are placed between a top plate 75 and a bed plate 77 of a radio frequency dielectric sealer. A die rod 79 is positioned between the top plate 75 and the pieces of material 71 and 73. If a butt seam is to be formed, the die rod 79 may be provided with a sharpened edge 81**.

When the top plate 75 is lowered as illustrated in FIG. **8*b*, radio frequency waves are transmitted through the die rod 79 to the pieces of material 71 and 73. These radio frequency waves activate the molecules in the plastic and the relative movement of the molecules tends to generate heat which forms a bond between the pieces of material 71 and 73. A buffer or insulator 86 can be placed between the piece of plastic 73 and the bed plate 77** to increase the heat generated by the radio frequency waves.

As the piece of material 71 melts, beads 83 and 85 are formed along the edge of the die rod 79. If the rod 79 is provided with a sharpened edge 81, as is normally the case when a butt seam is formed, those portions of the plastic sheets 71 and 73 including the bead 85 are cut from the seal. The resulting butt seam is illustrated in FIG. **8*c* where the bed 83 appears along only one side of the seam. This type of seam has been found to be undesirable in the industry since pressure tending to separate the pieces of plastic 71 and 73, as shown by the arrows 87, place the resulting seal is tensile stress. Also, the butt seam is relatively weak on the side of the seam opposite the bead 83, along a line shown generally by the arrow 89**.

When a seal is formed in this manner, a relatively deep depression is created in the piece of material 71 which is contacted by the die rod 79. The piece of material 73 in contact with the bed plate 77 or the buffer 86 remains relatively flat and smooth. In the present mattress construction, the seams 25, 35, 37 and 47 are oriented with the relatively flat surface of the seam facing outwardly of the mattress 11. This provides the mattress with a relatively smooth outer surface which inhibits any snagging which might otherwise occur if the depressed sides of the seams were oriented to face outwardly.

The typical formation of a lap seam as illustrated in FIG. 8*d* wherein it is shown that the pieces of material 71 and 73 extend in opposite directions but overlap between the die rod 79 and the buffer 86. With this more desirable construction, both of the beads 83 and 85 remain with the lap seam as illustrated in FIG. 8*a*.

The lap seam configuration illustrated in FIG. 8*e* is particularly desirable for the seams 37, 47. FIG. 13 shows an enlargement of the seam 37 as illustrated in FIG. 4. As previously explained with reference to FIG. 8, the desirable lap seam configuration provides the beads 83 and 85 on opposite sides of the seal 37. If the flattened portion of the seam 37 is faced outwardly, these beads 83 and 85 will extend inwardly of the cavity 57. When the cavity 61 is inflated and the lateral portion 45 is bent backwardly to provide the concave configuration illustrated in FIG. 4, the bead 85 provides means for increasing the radius of curvature of the lateral portions 45 so that a sharp crease does not appear in the sheet member 27.

When it is desirable to seal a bag using a lap seam, the final seam must be formed with a portion 87 of the piece of material 73 bent back to extend beneath the die rod 79 and buffer 86 as illustrated in FIG. 8*f*. To inhibit bonding between the piece of material 73 and the bent back portion 87 thereof, a ground rod or heat sink rod 89 is typically inserted therebetween. This rod 89 diffuses the radio frequency waves transmitting beyond the overlapping pieces 71 and 73 so that the bent back portion 87 remains relatively cool.

A preferred method of construction the mattress 11 is illustrated in FIGS. 9 to 12. It is particularly advantageous that this preferred method of construction can begin with the provision of only four of the sheets 17, 19, 27 and 29 of the material all of which have the same size and shape. A separate inventory of sheet members having different sizes and shapes need not be maintained. Furthermore, the sheets 17, 19, 27 and 29 can be cut simultaneously.

Although the mattress 11 can be provided with generally any shape, it is most commonly provided with a rectangular configuration. In this form of construction, the sheet members 17, 19, 27 and 29 can be provided with a rectangular shape. The four corners of the sheets can be rounded to form a curve 90 and can be provided with an ear mark 91 in the center of the curve 90 to assist in alignment during subsequent steps of construction. To form the integral lap seam 47, the sheet members 17 and 27 can first be heat sealed along a line 93 which is displaced inwardly from the peripheral edges 21 and 31 of the sheets 17 and 27 respectively. The configuration of this line 93 is dependent upon the shape of the die rod 79. In a preferred method, the die rod 79 forming the line 93 has a U-shape. Thus the line 93 is provided with curved portions on either end of a straight portion, the curved portions being concentric with the curves 90 at the corners of sheets 17 and 27.

A similar heat seal can be made along the opposite sides of the sheet members 17 and 27 along a line 95. Then the U-shaped ends of the lines 93 and 95 can be joined along straight lines 97 and 99 to complete formation of the continuous, integral lap seam 37. Prior to the completion of the seam 37, the label 65 can be inserted between the sheets 17 and 27.

A hole 101 can be punched or otherwise constructed through the sheets 17 and 27 interiorly of the seam 37. A similar hole 103 can be provided outwardly of the seam 37 to extend through the sheet member 17 only. The valves 59 and 63 can thus be heat sealed into these holes 101 and 103, respectively, to provide ultimate access to the cavities 57 and 61 respectively.

The sheet members 19 and 29 can be similarly heat sealed to form the continuous, integral lap seam 47. Neither the valves 49, 63 nor the label 65 need be provided in these sheet members 19 and 29.

Following formation of the seams 37 and 47, the two pairs of sheet members 17, 27, and 19, 29 can be placed in overlapping relationship as illustrated in FIG. 10. To form the inner bag 51, the lateral portions 45 and 55 of the sheet members 27 and 29 respectively can be heat sealed together to form the inner peripheral lap seam 35. This step is illustrated in FIG. 11. In the preferred method, this seam 35 is formed by first bonding the lateral portions 45 and 55 in the corners of the mattress 11 and then joining the corner bonds to form the continuous seam 35. The ear marks 91 in the corners of the sheets 17, 19, 27 and 29 can facilitate alignment during formation of the corner bonds.

In order to provide the seam 35 with the desirable lap configuration, the ground rod 89 must eventually be inserted into the area between the central portions 43 and 53 of the sheets 27 and 29 respectively. When the seal 35 is completed and the cavity 57 is formed, rather than leaving the ground rod 89 or any other buffer material in the cavity 57, it has been found particularly advantageous to remove the rod 89 through the valve 59 as illustrated by the arrow 105.

With the completion of a lap seam 35, the lateral portions 41 and 51 can be similarly heat sealed to form the outer peripheral lap seam 25 as illustrated in FIG. 12. This seam can also be completed in the manner illustrated in FIG. 8*f*. Thus, the ground rod 89 can be inserted between the peripheral portions 41 and 51 and removed through the valve 63 as illustrated by the arrow 107 upon completion of the heat seal 25.

Thus the mattress 11 in one form of the invention can be constructed from four sheets of material all having the same size and shape, using only four seams of the preferred lap configuration. The cavity 61 can be inflated or deflated to provide an air frame or a water mattress only as desired. In addition, excess material in the corners of the mattress relieve pressure differentials between the cavities 57 and 61. Furthermore, a preferred method of mattress construction providing the desirable lap seam configuration can includes steps providing for the removal of a ground rod through valves associated with the respective cavities 57 and 61.

Although the invention as been disclosed with reference to a preferred embodiment of one form of the mattress, it will be appreciated that the inventive concept can be otherwise embodied so that the scope of the invention should be ascertained only with reference to the following claims.

I claim:

1. A mattress comprising:

a first sheet of flexible material defined by a plurality of peripheral edges;

a second sheet of flexible material defined by a plurality of peripheral edges;

means forming a first continuous seal between the first sheet and the second sheet along a line displaced from the peripheral edges of the first sheet and the second sheet, the first seal defining with the peripheral edge of the first sheet a first lateral portion and defining with the peripheral edge of the second sheet a second lateral portion;

a third sheet of flexible material defined by a plurality of peripheral edges;

a fourth sheet of flexible material defined by a plurality of peripheral edges;

means forming a second continuous seal between the third sheet and the fourth sheet along a line displaced from the peripheral edges of the third sheet and the fourth sheet, the second seal defining with the peripheral edge of the third sheet a third lateral portion and defining with the peripheral edge of the fourth sheet a fourth lateral portion;

means forming a third continuous seal between the second sheet and the third sheet along the peripheral edges of the second sheet and the third sheet;

means forming a fourth continuous seal between the first sheet and the fourth sheet along the peripheral edges of the first sheet and the fourth sheet; whereby the second and third sheets define a first cavity and the first, second, third and fourth lateral portions define a second cavity extending around the periphery of the first cavity.

2. The mattress recited in claim 1, further comprising:

means providing access to the first cavity for filling the first cavity with water to form a water mattress; and means providing access to the second cavity for filling the second cavity with air to form an air frame around the water mattress.

3. The mattress recited in claim 1 having a generally planar configuration wherein each of the first, second, third, and fourth continuous seals lies in substantially a plane and the planes associated with each of the first, second, third and fourth continuous seals are substantially parallel to the plane of the mattress 4. The mattress recited in claim 3 wherein the third and fourth seals are disposed in the same plane.

5. The mattress recited in claim 4 wherein the fourth seal is disposed in a first direction relative to the third seal and the first seal is disposed in a second direction relative to the second seal, and the first direction is substantially perpendicular to the second direction.

6. The mattress recited in claim 1 wherein the first and third lateral portions have a first area and the second and fourth lateral portions have a second area and the first area is substantially equal to the second area.

7. A fluid mattress comprising:

a first sheet of material;

a second sheet of material;

means for bonding the first sheet to the second sheet along a line to form a seal;

the first sheet being divided by the seal into a first portion and a second portion;

the second sheet being divided by the seal into a first portion and a second portion;

the first portion of the first sheet and the first portion of the second sheet being disposed in a contiguous, substantially planar relationship;

the second portion of the first sheet being bent back along the seal to form a curve in the second part of the first sheet and to provide the second portion of the first sheet with a diverging relationship with respect to the second portion of the second sheet; and means disposed along the edge of the seal and forming a rounded bead for increasing the radius of the curve of the second portions of the first sheet and thereby inhibit formation of a weakened crease along the edge of the seal.

8. The combination recited in claim 7 wherein the first and second sheets have characteristics for being heated sealed and the seal is a heat seal formed by melting at least one of the first and second sheets.

9. The combination set forth in claim 7 wherein the seal is a continuous seal and the first portions of the first sheet partially define a first cavity and the second portions of the first sheet and the second portions of the second sheet partially define a second cavity, the first cavity being adapted to receive water to form a water mattress and the second cavity being adapted to receive air to form an air frame peripherally of the water mattress.

10. A fluid mattress comprising:

a first fluid tight bag having first and second substantially planar portions forming major surfaces of the bag and a first edge portion connecting the first and second substantially planar portions at the periphery of the first and second substantially planar portions;

a second fluid tight bag having a third and fourth substantially planar portions forming major surfaces of the second bag and a second edge portion connecting the third and fourth substantially planar portions at the periphery of the third and fourth substantially planar portions;

the second bag being disposed in the first bag;

means for joining the first bag and the second bag to form a first fluid tight seal along a continuous line disposed between the first edge portion and the first substantially planar portion of the first bag and disposed between the second edge portion and the third substantially planar portion of the second bag;

means for joining the first bag and the second bag to form a second fluid tight seal along a continuous line disposed between the first edge portion and the second substantially planar portion of the first bag and disposed between the second edge portion and the fourth substantially planar portion of the second bag;

the first edge portion defining with the second edge portion a particular cavity interiorly of the first bag and exteriorly of the second bag, said particular cavity extending peripherally of the second bag;

means for providing access through the first bag into the second bag to provide for the filling of the second bag with fluid to form a fluid mattress; and means for providing access to the first bag to provide for filling of the particular cavity with air to form an air frame peripherally of the fluid mattress.

11. The fluid mattress recited in claim 10 wherein the second bag has substantially the same surface area as the first bag.

12. The fluid mattress recited in claim 10 wherein the means for joining the first bag and the second bag to form the first fluid tight seal is a first lap seam, and the means for joining the first and second bag to form the second fluid tight seal is a second lap seam.

13. The fluid mattress recited in claim 10 wherein the mattress has the general configuration of a rectangle and the inflation of the particular cavity provides the second edge portion at each of the corners of the rectangle with a configuration of a bubble.

14. The mattress recited in claim 1 wherein the first, second, third and fourth sheets have substantially the same surface area and substantially the same configuration.

15. The mattress recited in claim 1 wherein the first and second sheets form a pocket defined by the first seam, said pocket being sealed from the atmosphere by the first seam and being sealed from the first cavity by the first seam.

16. The mattress recited in claim 1 wherein the first seal has on one side thereof a depression and has on the other side thereof a generally flat surface, and the other side of the first seal is disposed to face outwardly of the mattress to provide the mattress with a generally flat exterior surface.

17. The mattress recited in claim 1 wherein:

the first and fourth sheets form a first bag having a first surface area;

the second and third sheets form a second bag having a second surface area;

the second bag is disposed within the first bag; and the first surface area is substantially equal to the second surface area.

18. The mattress recited in claim 1 wherein the first, second, third and fourth seams are continuous lap seams.

19. The combination recited in claim 7 further comprising:

a third sheet of material;

a fourth sheet of material;

means for connecting the third sheet of material to at least the second sheet of material to form a first cavity;

means for connecting the fourth sheet of material to at least the first sheet of material to form a second cavity; and the first cavity being isolated from the atmosphere by at least two of the sheets of material.

20. The combination recited in claim 7 wherein the first, second, third and fourth sheets of material have substantially the same surface area.

21. The combination recited in claim 7 wherein the seal is a continuous lap seam.

22. The fluid mattress recited in claim 13 wherein the single bubble has properties for extending inwardly of the second cavity when the pressure in the particular cavity exceeds the pressure in the second cavity and for extending inwardly of the particular cavity when the pressure in the second cavity exceeds the pressure in the particular cavity.

* * * * *